US011247237B2

(12) United States Patent
Rafferty

(10) Patent No.: US 11,247,237 B2
(45) Date of Patent: Feb. 15, 2022

(54) MOBILE AGGREGATE PROCESSING PLANT

(71) Applicant: PORTAFILL INTERNATIONAL LIMITED, Omagh (GB)

(72) Inventor: Malachy James Rafferty, Omagh (GB)

(73) Assignee: PORTAFILL INTERNATIONAL LIMITED, Omagh (GB)

( * ) Notice: Subject to any disclaimer, the term of this patent is extended or adjusted under 35 U.S.C. 154(b) by 0 days.

(21) Appl. No.: 16/889,468

(22) Filed: Jun. 1, 2020

(65) Prior Publication Data

US 2020/0384504 A1 Dec. 10, 2020

Related U.S. Application Data

(60) Provisional application No. 62/858,607, filed on Jun. 7, 2019.

(51) Int. Cl.

| | |
|---|---|
| ***B07B 1/46*** | (2006.01) |
| ***B07B 1/34*** | (2006.01) |
| ***B07B 13/16*** | (2006.01) |
| ***B07B 1/00*** | (2006.01) |

(52) U.S. Cl.

CPC ..... *B07B 1/34* (2013.01); *B07B 1/005* (2013.01); *B07B 1/46* (2013.01); *B07B 13/16* (2013.01)

(58) Field of Classification Search

CPC .. B07B 1/005; B07B 1/28; B07B 1/34; B07B 1/46; B07B 13/16

See application file for complete search history.

(56) References Cited

U.S. PATENT DOCUMENTS

| | | | | |
|---|---|---|---|---|
| 4,598,875 A * | 7/1986 | Bronson | ..... | B02C 23/12 241/101.76 |
| 5,183,160 A * | 2/1993 | McClain | ..... | B07B 1/005 209/234 |
| 5,285,905 A * | 2/1994 | Laprade | ..... | B07B 15/00 209/241 |

(Continued)

FOREIGN PATENT DOCUMENTS

| | | |
|---|---|---|
| CN | 105665266 A | 6/2016 |
| EP | 2359944 A2 | 8/2011 |

(Continued)

OTHER PUBLICATIONS

Extended Search Report, dated Nov. 19, 2020 in European Patent Application No. 19178915.9.

(Continued)

*Primary Examiner* — Joseph C Rodriguez

(74) *Attorney, Agent, or Firm* — Faegre Drinker Biddle & Reath LLP

(57) ABSTRACT

The present invention relates to a mobile aggregate processing plant for screening aggregate material comprising a mobile chassis having a main frame and a vibrating screening unit mounted via one or more absorbers on a screen-mounting frame and able to provide at least one aggregate discharge stream therethrough, wherein the vibrating screening unit is moveable relative to the screen-mounting frame between a first in-use position, and at least a second position able to provide an access portal below the vibrating screening unit when not in use.

18 Claims, 7 Drawing Sheets

(56) References Cited

U.S. PATENT DOCUMENTS

| | | | | |
|---|---|---|---|---|
| 5,577,618 | A * | 11/1996 | Rafferty | B07B 1/005 209/244 |
| 5,878,967 | A | 3/1999 | Conner | |
| 6,698,594 | B2 | 3/2004 | Cohen et al. | |
| 7,461,746 | B1 * | 12/2008 | Egge | B02C 21/02 209/268 |
| 8,783,443 | B2 | 7/2014 | Erkkilä | |
| 9,694,363 | B2 * | 7/2017 | Salminen | B65G 41/002 |
| 9,869,145 | B2 * | 1/2018 | Jones | E21B 21/065 |
| 2013/0037454 | A1 | 2/2013 | Schirm et al. | |
| 2019/0160492 | A1 * | 5/2019 | Kruse | B07B 1/005 |

FOREIGN PATENT DOCUMENTS

| | | | |
|---|---|---|---|
| EP | 3409381 | A2 | 12/2018 |
| WO | 2009141626 | A2 | 11/2009 |

OTHER PUBLICATIONS

Extended European Search Report for related EP Application No. 20177645.7 dated Nov. 5, 2020, 12 pages.

* cited by examiner

MOBILE AGGREGATE PROCESSING PLANT

RELATED APPLICATION

This application is related to and claims priority from U.S. Provisional Application No. 62/858,607 filed Jun. 7, 2019, the disclosure of which is incorporated herein by reference in its entirety.

FIELD OF THE INVENTION

The present invention relates to a mobile aggregate processing plant for screening aggregate material, generally to separate by 'screening' a mixed size or coarseness of an aggregate feed material into two or more discharge streams of different particle size.

BACKGROUND

Mobile aggregate processing plants for screening aggregate material are well known in the art: see for example U.S. Pat. No. 669,859B2. They generally comprise a vibrating screening unit, sometimes termed a 'screen box', having a series of heavy-duty screens with defined openings that are vibrated by a motor moving the screen box and acting against a series of absorbers, usually springs, mounted on a supporting frame, such that an aggregate feed material can be separated by the moving screens into different sized discharge streams. Typically, there are one or more discharge streams at or near the end of the vibrating screening device of different particle sizes or coarseness, whilst that part of the aggregate material with a dimension less than the openings in the screens, is drawn by gravity down through the screen openings, and can be collected directly beneath the screening unit.

It can sometimes be desired to alter the level of 'vibration' of the vibrating screening unit by changing the springs, but this requires the deconstruction of the supporting frame.

The discharge streams can be directed away from the plant by various suitable conveyors, generally being positioned in different directions, into suitable piles or into suitable containers or trucks, etc. Once feed material at one location is screened, the mobile aggregate processing plant can be relocated for processing a new feed of aggregate material, typically at or near the same site. The screens may be arranged in a series of levels, sometimes termed 'decks', such as 'upper deck' and 'lower deck'.

The action of the vibrating screening unit is usually of such 'heavy duty', that regular repair, tightening, or replacement of the screen therein is required. Replacement of the screens is also sometimes required when the nature of the aggregate feed material changes, or different grades or types of discharge streams are required.

Vibrating screen units can be used in various mobile aggregate processing plants, possibly in conjunction with one or more other apparatus units or devices such as a crusher.

EP3409381A2 discloses an improved mobile aggregate processing plant comprising a mobile chassis, a vibrating screening unit mounted on the mobile chassis, and an underscreen conveyor which is driveable in an uphill direction so as to be able to discharge the aggregate discharge stream at a height higher than receiving the aggregate discharge stream from the vibrating screening unit, and relative to the mobile chassis.

EP2359044A2 discloses a self-propelled screen for sorting aggregate materials, including a single elongate discharge conveyor tiltably coupled to a body, and a screening device coupled tiltably relative to a conveyor frame. However, the screening device is fixed to a screening device frame that still prevents full access to the screening device.

SUMMARY OF THE INVENTION

It is an object of the present invention to provide an improved mobile aggregate processing plant which provides improved access below the vibrating screening unit when not in use.

According to one aspect of the present invention, there is provided a mobile aggregate processing plant for screening aggregate material comprising a mobile chassis having a main frame and a vibrating screening unit mounted via one or more absorbers on a screen-mounting frame and able to provide at least one aggregate discharge stream therethrough, wherein the vibrating screening unit is moveable relative to the screen-mounting frame between a first in-use position, and at least a second position able to provide an access portal below the vibrating screening unit when not in use.

Movement of the vibrating screening unit relative to the screen-mounting frame also allows access to the lower part of the vibrating screen unit otherwise inaccessible by the screen-mounting frame, especially for replacement of the screens, such as tightening of relevant bolts, nuts etc, such as those holding the screens. In this way, internal access into the vibrating screening unit can be wholly or substantially avoided.

Movement of the vibrating screening unit relative to the screen-mounting frame also allows access to the one or more absorbers to allow for their easy repair or replacement, for example when it is desired to alter the damping amount or strength of the one or more absorbers. The vibrating screening unit may be moveable relative to the screen-mounting frame to more than one second position. Preferably, at least one second position is a second non-use position.

Optionally, the vibrating screening unit is moveable at one end relative to the screen-mounting frame. Optionally, the vibrating screening unit is moveable at either end relative to the screen-mounting frame.

Optionally, the vibrating screening unit is moveable at both ends relative to the screen-mounting frame.

Typically, a vibrating screen unit has an aggregate feed end and a discharge end, with a series of heavy-duty screens therein between. The present invention is able to provide an access portal below the vibrating screen unit at either end, or at both ends. The movement of one or both ends may relate to the positioning of the vibrating screen box relative to the remainder of the mobile aggregate processing plant, in particular relative to the other parts, units or frames of the mobile aggregate processing plant.

The mounting of the vibrating screen unit on the mobile aggregate processing plant may be at any suitable location. In one embodiment, the vibrating screen unit is located between a feed hopper and one or more discharge conveyors. In another embodiment, the vibrating screen unit is located on or otherwise above a conveyor, and mounted thereon.

The screen-mounting frame is designed to wholly or substantially support the vibrating screen unit.

Optionally, the mobile aggregate processing plant further comprises one or more sub-frames, and the screen-mounting frame is a first sub-frame. In this way, the vibrating screening unit is moveable relative to a first sub-frame. Optionally, the first sub-frame is mounted on the main frame of the mobile aggregate processing plant. Optionally, any such first sub-frame is also moveable relative to the main frame, for example via one or more actuators, typically but not limited to vertical displacement of the vibrating screening unit relative to the main frame.

The vibrating screen unit is mounted in the first in-use position to the screen-mounting frame via one or more absorbers. Typically, the vibrating screen unit is mounted to the screen-mounting frame via a plurality of absorbers arranged on or around the screen-mounting frame, typically symmetrically thereon or therearound, and able to at least partly absorb or dampen the action of the vibrating screening unit relative to the remainder of the mobile aggregate processing plant.

The absorbers include, but are not limited to one or more of the group comprising: springs, actuators, ram and pistons, and dampers; typically springs such as damper springs.

Optionally, the one or more of the absorbers comprise at least one or two sets of multiple damper springs on each side of the vibrating screening unit. Optionally, the one or more of the absorbers comprise at least two sets of 1, or 2 or 3 or 4 or more damper springs on each side of the vibrating screening unit.

Optionally, movement of the vibrating screening unit to a second position relative to the screen-mounting frame allows access to the one or more absorbers, preferably ease of replacement of one or more of the absorbers. Optionally, the one or more absorbers are only permanently attached to either the vibrating screening unit or the screen-mounting frame, so that movement of the vibrating screening unit to a second position relieves the weight of the vibrating screening unit thereon to allow their easy detachment from the vibrating screening unit or screen-mounting frame.

Movement of the vibrating screening unit may be facilitated by a variety of actuators based on the driving force for the system. Driven systems may be optionally mechanically, electro-mechanically, or hydraulically or pneumatically driven.

Optionally, the vibrating screening unit is moveable in an upward direction by one or more of the group comprising: actuators, springs, ram and pistons, and screws.

Optionally, the vibrating screening unit is moveable in an upward direction by one or more hydraulic ram and pistons located between the vibrating screening unit and the screen-mounting frame. Optionally, the ends of the or each hydraulic ram are configured between the vibrating screening unit and the screen-mounting frame. Optionally, the ends of the or each hydraulic ram are configured at or near one end of the vibrating screening unit and the screen-mounting frame. Optionally, the vibrating screening unit is moveable in an upward direction by two hydraulic ram and pistons located between the vibrating screening unit and the screen-mounting frame, one hydraulic ram and piston located on each side of the vibrating screening unit and the screen-mounting frame.

Optionally, the vibrating screening unit is pivotable on the screen-mounting frame, at least at one end, during movement of the vibrating screening unit to a second position. Optionally, the vibrating screening unit is not pivotable on the screen-mounting frame in the first in-use position, so that the weight and motion of the vibrating screening unit in use relative to the screen-mounting frame is wholly or substantially carried by the one or more absorbers.

Optionally, the vibrating screening unit includes spigots, pivot pins, or the like at least at one end, and the screen-mounting box includes complementary pin housings or hooks or the like, which spigots, pins, etc and pin housings are configured to be not engaged when the vibrating screening unit is in its first in-use position, and which are configured to be engaged when the vibrating screening unit is moving to a second position relative to the screen-mounting frame. For example, movement of the vibrating screening unit could cause the engagement to start and finish.

Optionally, the mobile aggregate processing plant further comprises an underscreen conveyor. Optionally, the underscreen conveyor is located wholly or substantially beneath the vibrating screening unit to wholly or substantially receive said at least one aggregate discharge stream.

Optionally, the underscreen conveyor is shorter than the vibrating screening unit.

Optionally, the underscreen conveyor is mounted on the mobile chassis independently of the mounting of the vibrating screening unit on the mobile chassis. For example, where the mobile chassis has a main frame and at least one sub-frame, the underscreen conveyor could be mounted on the main frame, and the vibrating screening unit could be mounted on the first sub-frame.

Optionally, the underscreen conveyor is vertically and/or laterally moveable relative to the screen-mounting frame between the operating and non-operating configurations.

Optionally, the underscreen conveyor and the vibrating screening unit are movable apart between a co-operating operating configuration and an open non-operating configuration, optionally to maximise the space therein between for an operator to work in or around or through, and/or to maximise access to the vibrating screening unit.

Optionally, the underscreen conveyor works in co-operation with the vibrating screening unit when the vibrating screening unit is in a first in-use position.

Optionally, the underscreen conveyor is driveable in an uphill direction so as to be able to discharge the aggregate discharge stream at a height higher than receiving the aggregate discharge stream, and the vibrating screening unit and underscreen conveyor are driveable in the same direction.

Optionally, the vibrating screening unit comprises at least a series of upper screens and a series of lower screens, and one or more of the lower screens are removeable when the underscreen conveyor is in the non-operating configuration.

Optionally, the underscreen conveyor includes one or more wings to increase the aggregate discharge catchment area of the underscreen conveyor. The wings may be moveable relative to the conveyor belt, to increase the access portal.

Optionally, the mobile aggregate processing plant further comprises a post-screening discharge conveyor located at least partly beneath the vibrating screening unit to receive at least some of the aggregate discharge stream from the vibrating screening unit.

Optionally, the mobile aggregate processing plant further comprises a crusher, crusher unit, or other crushing means. Optionally, the crusher is mounted on the mobile chassis.

Optionally, the vibrating screening unit has an aggregate feed end or 'inlet end', and a discharge end or 'outlet end. The vibrating screening unit is operable in various modes and locations, including horizontal or inclined, i.e. having the aggregate feed end higher than the discharge end relative to the mobile chassis.

Optionally, the mobile aggregate processing plant further comprises one or more of the group comprising: an aggregate feed hopper, an aggregate feed conveyor, one or more post-screening discharge conveyors, and a crusher. One or more of said groups may be supported by one or more sub-frames of the mobile aggregate processing plant.

Optionally, the mobile aggregate processing plant described herein at least comprises:

a mobile chassis having tracked mobility;

an aggregate feed hopper to receive aggregate material;

an aggregate feed conveyor to transfer the aggregate material to a vibrating screening unit;

a vibrating screening unit having an aggregate feed end and an discharge end, and comprising at least two screens driveable to screen the aggregate material into at least two different aggregate discharge streams of different particle sizes, at least one of which is discharged directly through the vibrating screening unit, wherein the vibrating screening unit is moveable relative to the screen-mounting frame between a first position in which the vibrating screening unit is in use, and at least a second position able to provide an access portal below the vibrating screening unit when not in use;

one or more post-screening discharge conveyors able to convey a discharge stream from the vibrating screening unit to a different location.

Optionally, the mobile aggregate processing plant has at least one post-screening discharge conveyor extending in a non-parallel direction to the vibrating screening unit.

Optionally, the mobile aggregate processing plant has two or more post-screening discharge conveyors extending laterally to the sub-frame and vibrating screening unit.

Optionally, the mobile aggregate processing plant has at least one post-screening discharge conveyor extending in a non-parallel direction to the vibrating screening unit, and two or more post-screening discharge conveyors extending laterally to the vibrating screening unit.

Optionally, the mobile aggregate processing plant is able to be located within an ISO high cube container.

According to another aspect of the present invention, there is provided a method of servicing a mobile aggregate processing plant for screening aggregate material comprising a mobile chassis having a main frame and a vibrating screening unit mounted via one or more absorbers on a screen-mounting frame, comprising at least the steps of:

moving the vibrating screening unit between a first in-use position, and at least a second position able to provide an access portal below the vibrating screening unit when not in use; and accessing the vibrating screening unit from below.

Optionally, the mobile aggregate processing plant further comprises an underscreen conveyor wholly or substantially located beneath the vibrating screening unit to receive the aggregate discharge stream discharged through the vibrating screening unit, and the method further comprises:

moving the underscreen conveyor away from the vibrating screening unit between a co-operating operating configuration and an open non-operating configuration.

Optionally, when an underscreen conveyor is present, the method further comprises moving the underscreen conveyor away from the vibrating screening unit between a co-operating operating configuration and an open non-operating configuration.

BRIEF DESCRIPTION OF THE DRAWINGS

An embodiment of the present invention will now be described by way of example only, and with reference to the accompanying drawings in which.

DESCRIPTION OF THE EMBODIMENTS

Figure 1:
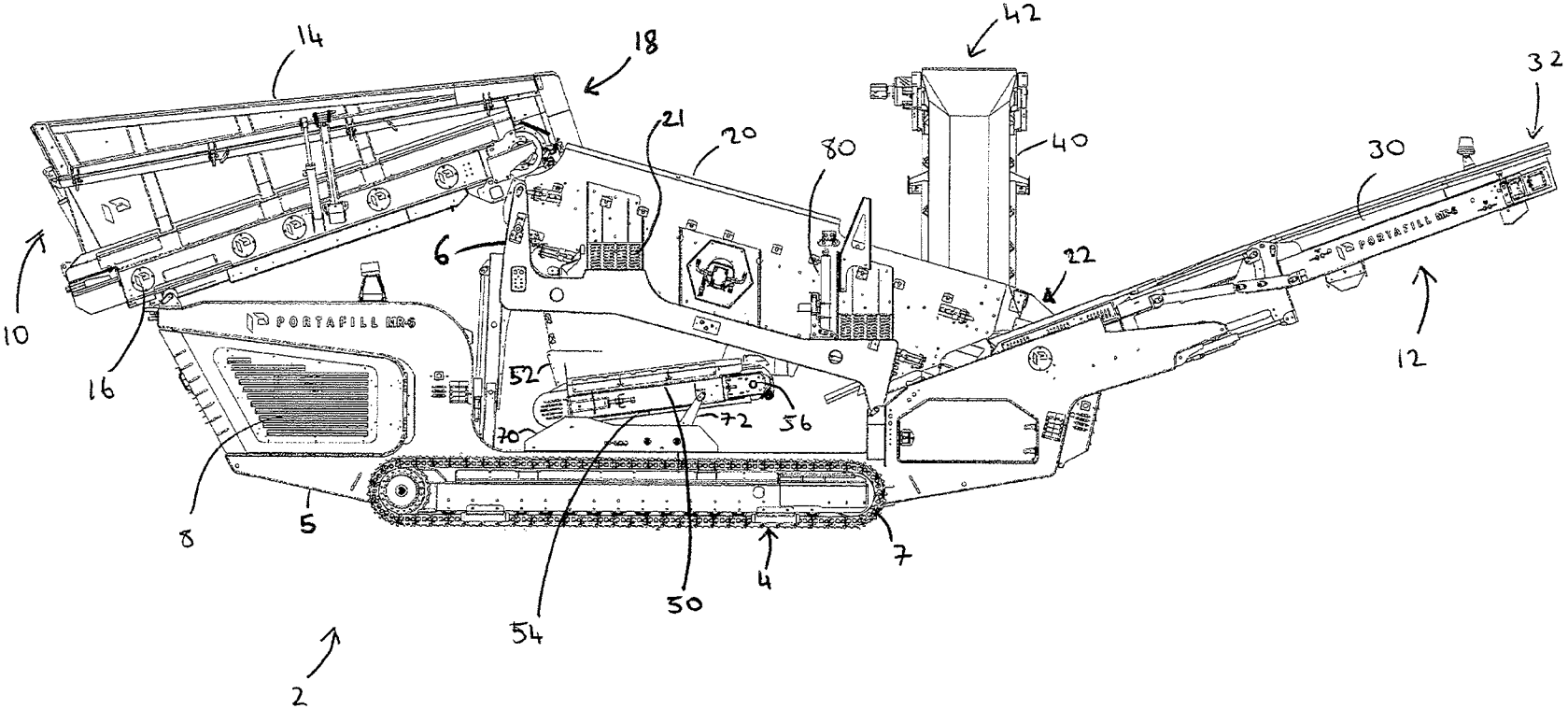
FIG. 1 is a side view of a mobile aggregate processing plant according to one embodiment of the present invention having a vibrating screening unit in a first position.

The present invention relates to a mobile aggregate processing plant for screening aggregate material. Mobile aggregate processing plants are well known in the art, and generally comprise a mobile chassis, which may be typically formed of a frame or framework, having an undercarriage, and typically a plurality of wheels on each side, optionally with a caterpillar-type track or tracking around the wheels in a manner known in the art. The action and ability of caterpillar tracks is well known in the art, and is not further discussed herein.

Optionally the plant may be self-mobile, usually within an area or range, such as within a working area or areas at which it is desired to process aggregate material, such as a demolition site or rock-processing site. Such mobility can be provided by a suitable motor on the mobile chassis.

Optionally, the mobile aggregate processing plant of the present invention can be located within an ISO 40 foot container, or an ISO high cube container, in a transport configuration, or in an alternative, the mobile aggregate processing plant may be able to be towed on a public highway by a large vehicle, or towed on a suitable trailer, wherein being able to reduce the overall height of the mobile aggregate processing plant can also allow larger sized mobile aggregate processing plants to be more conveniently transported from place to place.

The plant of the present invention includes a mobile chassis typically being an elongate frame able to support most or all of the other components or features of the mobile aggregate processing plant. In one embodiment, the mobile chassis includes one or more sub-frames, including a first sub-frame to mount and support the vibrating screening unit. Optionally, the mobile chassis includes a second sub-frame to support a feed hopper (described hereinafter), and possibly one or more third sub-frames to support one or more discharge conveyor.

In one view, the mobile chassis has an elongate arrangement, with one end generally being for the provision of aggregate feed material to be screened, sometimes termed an 'aggregate feed end' or 'inlet end', and an opposing end generally being for the location of one or more discharges of screened material, sometimes also termed a 'discharge end'.

At the aggregate feed end, the present invention may include an aggregate feed hopper designed or configured to receive a feed or other supply of aggregate material, which may be provided by any suitable supply means. The hopper is typically designed to direct the aggregate feed towards an aggregate feed conveyor located at the bottom of the hopper, and typically having a conveyor belt able to convey the aggregate feed towards a discharge end of the conveyor belt, which discharge end is able to transfer the feed aggregate into and/or onto one end of a vibrating screening unit. Optionally, the aggregate feed conveyor is inclined, typically in an uphill direction towards its discharge end.

Vibrating screening units are well known in the art, and typically comprise a plurality of screens having openings of defined dimensions. Optionally, the vibrating screening unit has screens having openings of two or more different sizes. Further optionally, the vibrating screening unit has multiple layers or 'decks' of screens, including 'half decks'. A typical configuration comprises an 'upper deck' of screen or screens, and a 'lower deck' screen or screens.

The skilled man is aware of many arrangements possible and available for locating various screens within a vibrating screening unit. One typical arrangement comprises a series of upper screens having openings of one size, and a series of lower screens having openings of a different size, typically of a smaller size than the openings of the upper screen.

The screens are typically vibrated by the use of one or more motors, sometimes providing eccentric motion, and able to move at least one part of each screen relative to another part, to create motion of the screens and hence to help 'screen' or separate the mixed aggregate feed material into at least two different particle sizes or 'grades', optionally more than two different particle sizes, some of which can pass through at least one screen, optionally both or all screens, and some of which cannot.

To assist the separating action, the vibrating screening unit is inclined from its upper inlet end receiving the aggregate feed material from the aggregate feed conveyor, downwardly towards its discharge or outlet end, from where there can be one or more discharges of at least one grade of aggregate discharge stream. The downward inclination of the vibrating screening unit uses gravity to provide at least some of the movement of the aggregate material along the vibrating screening unit, and so helps a continuous screening action to occur along the length of the vibrating screening unit.

At the outlet end of the vibrating screening unit, there may be one or more post-screening discharge conveyors, able to convey a particular grade or coarseness of screened material as a discharge stream from the vibrating screening unit to a different location. One discharge stream may be that portion of the feed aggregate material that is unable to pass through every screen of the vibrating screening unit, i.e. which typically passes across the top of all screens and is discharged as the coarsest grade or an 'uppermost' stream, typically comprising the largest or coarsest particle size or sizes of the aggregate feed material.

Where the vibrating screening unit may comprise at least two decks of screens having different sized openings, there can be provided at least one, optionally more, intermediate grade or coarseness of screened material, comprising that portion of the feed aggregate material that can pass through an upper deck, but not through a lower deck of screens. Such a discharge stream(s) could be provided to a collecting end of a post-screening discharge conveyor, for conveying to a discharge end thereof and into a separate container or to form a separate pile.

The skilled man can see that there could be a number of grades of discharge streams from the end of the vibrating screening unit, depending upon the number and type of screens therein, each of which could provide a separate grade of discharge stream, for separate conveying to a separate container or pile.

The skilled man can also see that one or more of the post-screening discharge conveyors may be arranged to be at the same or a different longitudinal direction as the vibrating screening unit. In one example, there can be one post-screening discharge conveyor having the same longitudinal direction as the vibrating screening unit, and one or more post-screening discharge conveyors being at an angle thereto, including at a 90° angle, i.e. lateral to the longitudinal direction of the vibrating screening unit, and typically lateral to the mobile aggregate processing plant.

In the present invention, the vibrating screening unit is mounted via one or more absorbers on a screen-mounting frame, and moveable relative to the screen-mounting frame between a first in-use position, and at least a second position able to provide an access portal below the vibrating screening unit when not in use. The vibrating screening unit is moveable in one or more dimensions and/or directions to increase the gap or space between the vibrating screening unit and the screen-mounting frame, and/or the main frame or another part of the plant.

In particular, the vibrating screening unit is moveable between a first in-use position and at least a second non-use position, so that better access to at least the underside of the vibrating screening unit is possible. Such access has dramatic benefit during the maintenance and/or repair and/or replacement work required to maintain the vibrating screening unit, or change the screens for another reason. For example, screens used in a vibrating screening unit can 'wear out' and/or break, typically regularly and without warning. It is expected during the normal operation of a mobile aggregate processing plant for screening aggregate material to replace the screens of a vibrating screening unit regularly. Where such screens are accessible from an upper position on or over the vibrating screening unit, such replacement may be a relatively fast and simple exercise. Where such screens are located in a lower part or deck or otherwise underneath the vibrating screening unit, such access is not possible where the remainder of the plant, such as a fixed screen-mounting frame, or a discharge conveyor or an underscreen conveyor, is deliberately located close to, in particular parallel with, the vibrating screening unit, and has no movement relative thereto without dismantling the plant.

In the first in-use position the vibrating screening unit work in co-operation in a manner known in the art to provide one or more aggregate discharge streams.

According to an embodiment of the present invention, the vibrating screening unit may be moveable in an upward direction by one or more actuators, such as a plurality of hydraulic ram and pistons, between the vibrating screening unit and the screen-mounting frame, optionally located thereinbetween. The vibrating screening unit may be moveable at one end, or at both ends thereof, based on suitable location of the one or more actuators.

In one embodiment of the present invention, the vibrating screening unit is mounted onto a conveyor, such as a discharge conveyor, using one or more dedicated mountings on the conveyor to mount and support the vibrating screening unit.

In another embodiment of the present invention, the mobile aggregate processing plant of the present invention can include an underscreen conveyor, located wholly or substantially located beneath the vibrating screening unit. The underscreen conveyor is shorter in length than the vibrating screening unit so as to fit thereunder and still allow the unscreened material to discharge separately from one end. The underscreen conveyor is located to receive an aggregate discharge stream which is able to pass down through the vibrating screening unit before reaching the outlet end of the vibrating screening unit from which larger grades of material are discharged. Such an aggregate discharge stream generally comprises that portion of the aggregate feed material that is sized to be less than all screens in the vibrating screening unit, sometimes termed the 'fines', being the finest discharge material, and such material discharges downwardly through the screens of the vibrating screening unit prior to reaching the outlet end of the vibrating screening unit.

An underscreen conveyor may include one or more conveyor belts, typically one conveyor belt driven from at least one end, typically in a forward motion to convey a received discharge stream to a discharge end.

Optionally, the discharge end of an underscreen conveyor is able to discharge received material onto a post-screening discharge conveyor, which post-screening discharge conveyor may be in line with, or at an angle to, or lateral to, the longitudinal direction of the mobile chassis and/or the vibrating screening unit. Optionally, the post-screening discharge conveyor is located at least partly beneath the vibrating screening unit to receive at least some of the aggregate discharge stream from the vibrating screening unit. In this way, the underscreen conveyor does not need to have a catchment area that extends the full extent or length of the discharge below the vibrating screening unit.

Optionally, any underscreen conveyor is also moveable relative to the vibrating screening unit to further improve the space for access below the vibrating screening unit when not in use, in particular accessibility by repair or service personnel to the bottom or the lower parts and/or underneath of the vibrating screening unit. An underscreen conveyor could be supported on the mobile chassis using one or more supports, typically including at least one or more legs or struts, optionally extendable legs or struts, and/or including the use of one or more actuators or other ram and piston arrangements, whose movement or activation is able to move the position of the underscreen conveyor relative to the vibrating screening unit and/or the mobile chassis. Such movement may be in at least a vertical direction relative to the vertical screening unit, or in a lateral direction relative to the vertical screening unit, or both.

Such movement may also allow the underscreen conveyor and vibrating screening unit to be moveable apart between a co-operating operating configuration and an open non-operating configuration. The first configuration may be considered as an 'operating configuration', wherein the underscreen conveyor is able to wholly or substantially receive the at least one aggregate discharge stream passing directly through the vibrating screening unit, and to discharge said stream, optionally in an uphill direction, to its discharge end. The second configuration may be considered as a 'non-operating configuration', wherein the underscreen conveyor is not designed to co-operate with vibrating screening unit in use.

Alternatively or additionally, the mobile aggregate processing plant of the present invention may include a crusher. One example of a crusher is a jaw crusher. Jaw crushers are particularly suitable for, rough crushing at quarries, or crushing of waste or construction materials. The crusher may be of any size, shape, design or arrangement, generally having one or more jaws or arms, an upper portion adapted to receive material, typically from a feed hopper or the like, and one or more discharge outlets, typically starting at a low or lower portion, optionally at the bottom of the crusher, and able to allow crushed material to pass out away from the crusher, typically on to one or more conveyor belts or the like.

Figure 2:
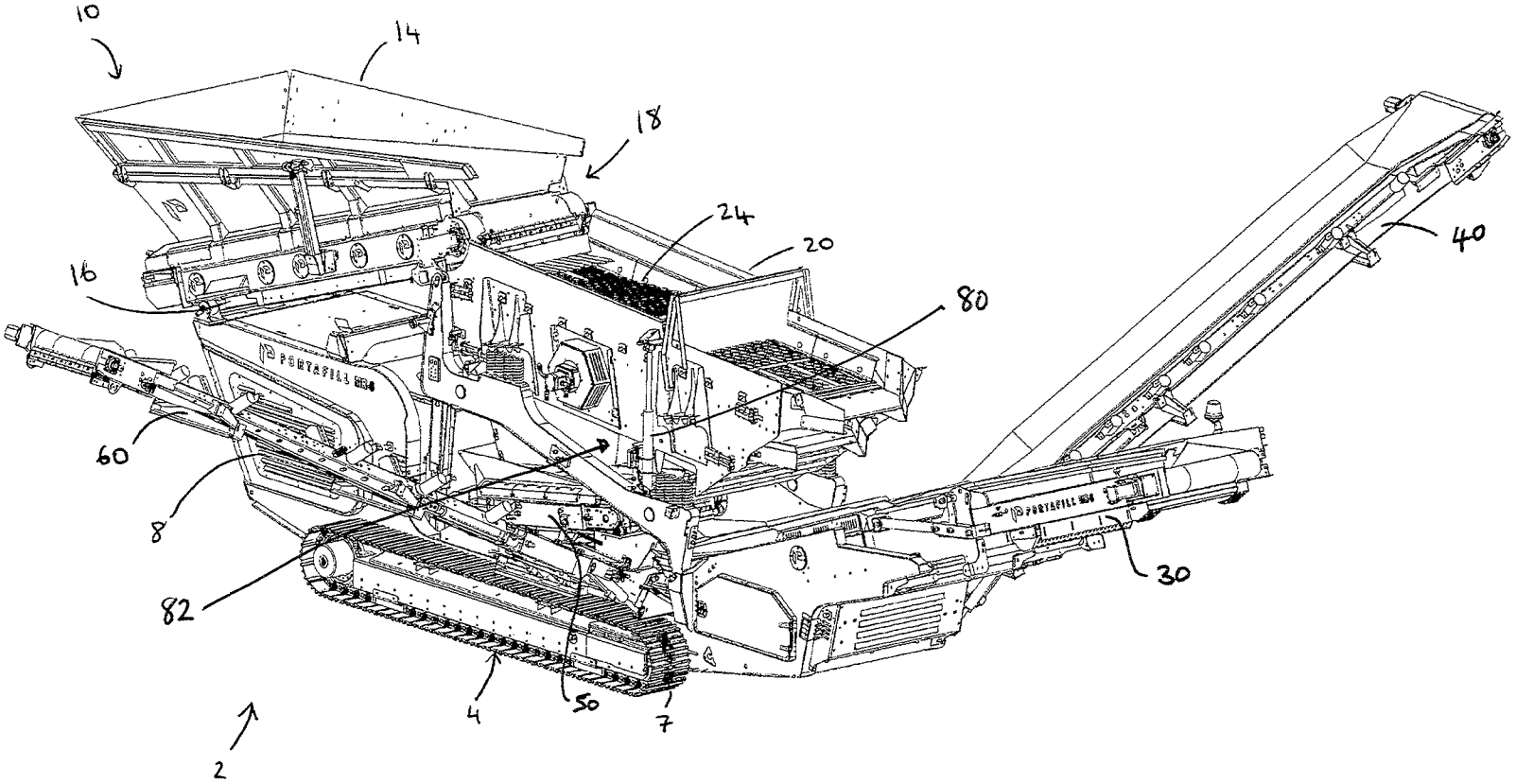
FIG. 2 is a perspective view of the plant of FIG. 1 with the vibrating screening unit in a second position.
Figure 3:
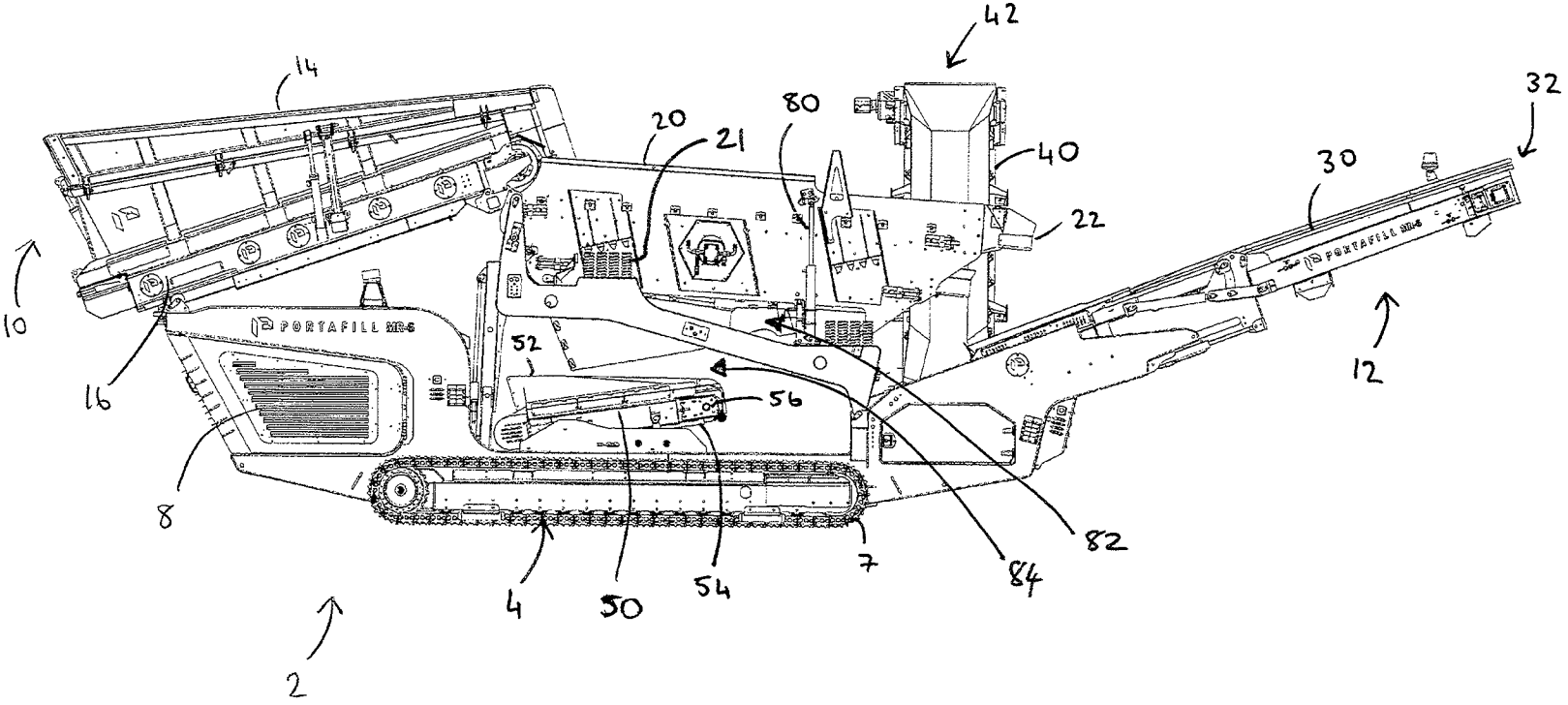
FIG. 3 is a side view of FIG. 2 having an underscreen conveyor in a second configuration.

With reference to FIGS. 1-3, there is shown an embodiment of a mobile aggregate processing plant 2 according to the present invention for screening a mixed grade aggregate feed material (not shown), and based on also having an underscreen conveyor in combination with the vibrating screening unit. The plant 2 comprises a mobile chassis 4, comprising at least a main frame 5 and a first sub-frame 6. The mobile chassis 4 has caterpillar tracks 7 to provide its mobility, at least within a location or range, and an engine 8.

The first sub-frame 6 supports a vibrating screening unit 20 discussed hereinafter, and the main frame 5 is able to support directly or via or more other sub-frames the other components of the mobile aggregate processing plant. The main frame 5 and first sub-frame 6 may be integrally formed, or relatively moveable.

Generally, the mobile chassis 4 has an elongate arrangement, able in this way to define one end being a 'hopper end' 10 for the provision of aggregate material to be screened, and a discharge end 12, wherein one or more grades of discharge material, generally in the form of discharge streams, can be discharged, typically towards distinct or separate locations or for further conveyance means or mechanisms such as containers or trucks or trailers.

The hopper end 10 includes an aggregate feed hopper 14 known in the art, and able to create an enlarged opening above an aggregate feed conveyor 16, and so direct aggregate feed material that is provided into the hopper 14 down towards the conveyor belt of the aggregate feed conveyor 16. The aggregate feed conveyor 16 conveys the feed aggregate material from a generally lower end, upwardly towards a discharge end 18, and into a receiving or inlet end of a vibrating screening unit 20. The vibrating screening unit 20 is inclined downwardly from the inlet end, to a discharge or outlet end 22, which incline allows gravity to assist the movement of the mixed aggregate feed material along the length of the vibrating screening unit 20 in a manner known in the art.

The vibrating screening unit 20 comprises an upper deck of upper screens 24 (shown in FIG. 2) having openings of a first size, and a lower deck of aligned lower screens under the upper screens 24, and having openings of a smaller size than the openings in the upper screens 24.

The motion, action and effect of a vibrating screening unit 20 is known in the art, often involving eccentric motion, and possibly based on using eccentric weights, which are able to move, in particular vibrate, optionally vibrate rapidly, the screens, causing the mixed aggregate feed material to separate, and allowing that material which is able to pass through all the openings in the screens, the 'fines', to pass downwardly therethrough.

As is known in the art, that portion or grade of the aggregate feed material that cannot pass through even the largest screen openings, being those of the upper screens 24 in the example shown in FIG. 1, provides a 'most coarse' grade of discharge material having the largest average particle size, diameter or other dimension. This material is provided as one discharge stream to the top of the discharge end 22 of the vibrating screening unit 20 and onto a first post-screening discharge conveyor 30. The first such conveyor 30 may be in line with the vibrating screening unit 20, and has a discharge end 32 able to provide its discharge stream to a first location or to a first container or the like.

That portion or grade of the aggregate feed material that can pass through the openings in the upper screens 24 but not through the smaller openings of the lower screens can be provided as a second grade of material, and as a discharge stream onto a second post-screening discharge conveyor 40, to be conveyed therealong to a second discharge end 42 to a separate location or separate container, etc. The example of the present invention shown in FIGS. 1 and 2 shows the second conveyor 40 being in a lateral direction to the general direction of the vibrating screening unit 20 and the first discharge conveyor 32.

Figure 4:
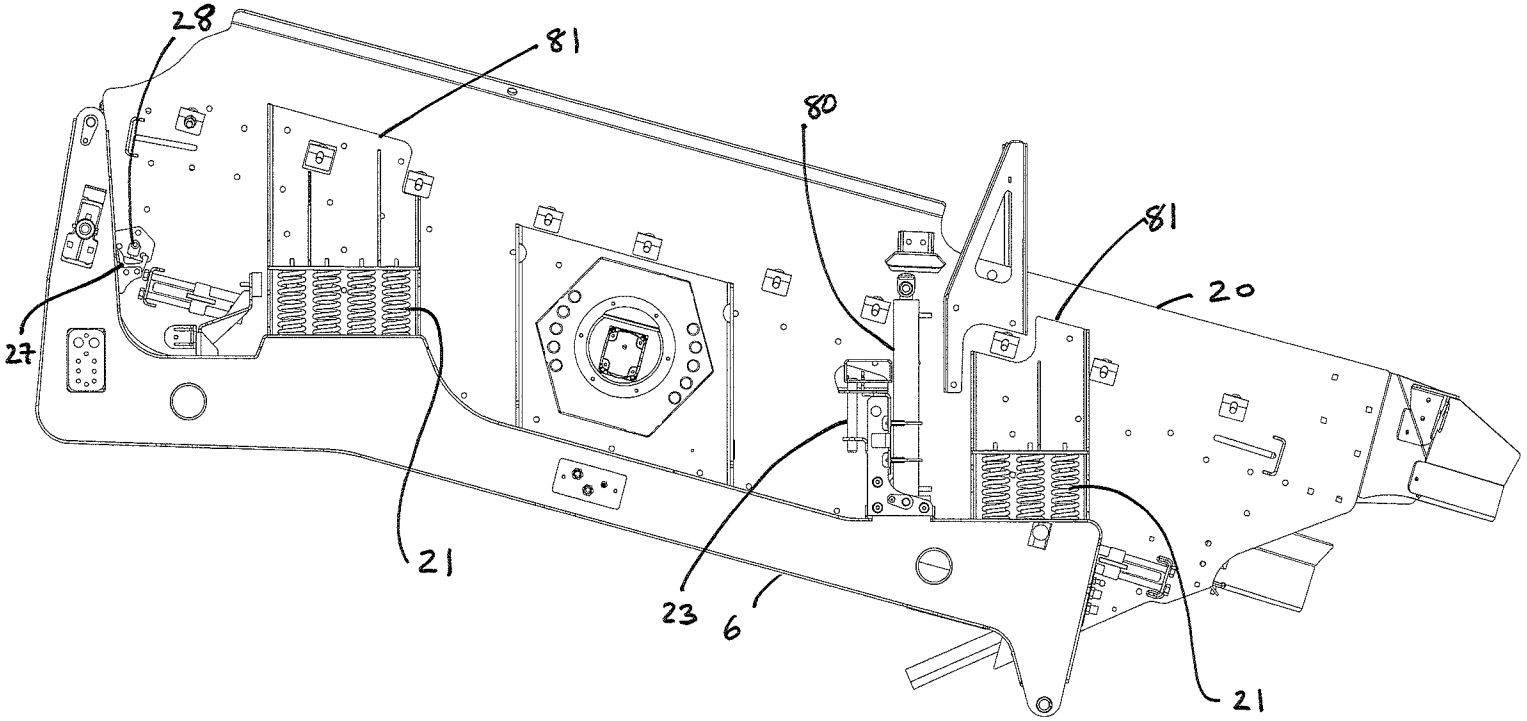
FIGS. 4 and 6 are enlarged side views of a portions of FIGS. 1 and 2 respectively.

In the example of the invention shown in the Figures, the first sub-frame 6 supports a vibrating screening unit 20 on four sets of damper springs 21, shown in more detail in FIG. 4. FIG. 4 shows an enlarged portion of FIG. 1, in particular only the vibrating screening unit 20 and the first sub-frame 6 in detail, for clarity. Arranged in the example shown in FIG. 4 are a first set of three damper springs 21 near a lower end of the vibrating screening unit 20, and a second set of four damper springs 21 at another end of the vibrating screening unit 20, with complementary sets of springs on the other side of the vibrating screening unit 20.

The damper springs 21 are attached to suitable locations on the first sub-frame 6. Preferably, the damper springs 21 are affixed to the first sub-frame 6 via one or more suitable attachments, such as pins, bolts, etc.

FIG. 4 also shows complementary spring hangers 81 attached to the sides of the vibrating screening unit 20, and having a series of damper spring engagement portions.

FIG. 4 shows the vibrating screening unit 20 in a first in-use position relative to the first sub-frame 6, so that operation of the screens 24 by a suitable motor causes a vibrating motion of the vibrating screening unit 20, whose motion is dampened by the damper springs 21 in relation to the first sub-frame 6, and therefore for the remainder of the processing plant 2, in a manner known in the art.

FIGS. 1 and 4 also show a hydraulic ram 80 configured between, on one side, and near one end of the vibrating screening unit 20 and the first sub-frame 6. The plant 2 includes a symmetrical second hydraulic ram (not shown) configured between, near one end, and on the other side of the vibrating screening unit 20 and the first sub-frame 6.

In FIGS. 1 and 4, the hydraulic ram 80 is in a rest or unextended position, so that the vibrating screening unit 20 is in a first in-use or operational position.

Figure 6:
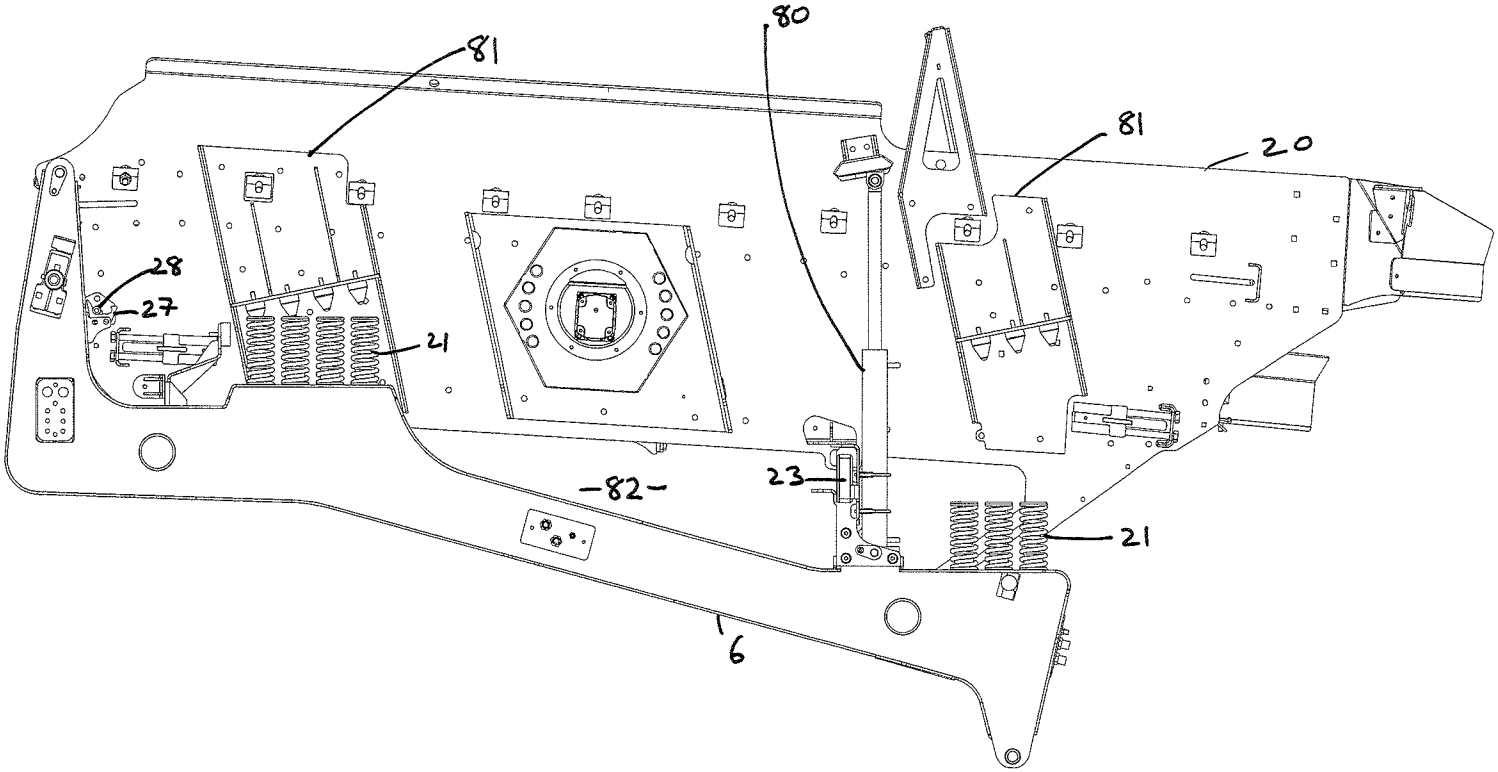

FIGS. 2 and 6 show the hydraulic ram 80 in an extended position, so that the vibrating screening unit 20 is in a second or non-operational position. The vibrating screening unit 20 is moveable upwards using the hydraulic rams 80. A representative indication of scale is to move the bottom of the vibrating screening unit 20 from a height above ground level from an exemplary value of 1365 mm in FIG. 1, to an exemplary value of 2022 mm in FIG. 2. This creates an access portal 82 below the vibrating screening unit, or between the vibrating screening until and the underscreen conveyor 50, for increased ease of access.

FIG. 6 shows the same portion of the mobile aggregate processing plant 2 as FIG. 4, in particular the vibrating screening unit 20 and the first sub-frame 6, now with the hydraulic ram 80 in an extended position to create the access portal 82 between the vibrating screening unit 20 and the first sub-frame 6.

FIGS. 4 and 6 also show a rotatable screen raise pin 23 on a housing between the vibrating screening unit 2 and the first sub-frame. The screen raise pin 23 is rotatable between a non-use position as shown in FIG. 4, and an in-use position as shown in FIG. 6. In the in-use position, the screen raise pin 23 is able to pin or lock the vibrating screening unit 20 at a second position, to assist supporting the weight, or at least act as a fail-safe relative to the hydraulic ram 80 whilst users are working in the access portal FIG. 6 also shows the separation of the spring hangers 81 on the vibrating screening unit 20 relative to the tops of the damper springs 21. This allows a user easy access to the damper springs 21, in particular for any repair or replacement of the damper springs 21. It is possible that a user may wish to achieve a lighter or a stronger damping effect for different types of aggregate materials or different separations, and the present invention allows the easy changing of the damper springs 21 to achieve a different damping strength or activity or amount relative to the vibrating screening box 20. The damper springs 21 merely require detachment from the first sub-frame 6.

FIG. 6 also shows ease of access to the lower portion of the vibrating screening unit 20 that may have otherwise been inaccessible if the first sub-frame 6 was permanently fixed to the vibrating screening unit 20. For example, FIG. 6 shows ease of access to certain bolts or nuts 83 holding some of the lower screens in place, which may be difficult or partially or inaccessible when the vibrating screening unit 20 is in its first in-use position as shown in FIG. 4. Thus, a user has much easier access for changing the screens in this way.

Figure 5:
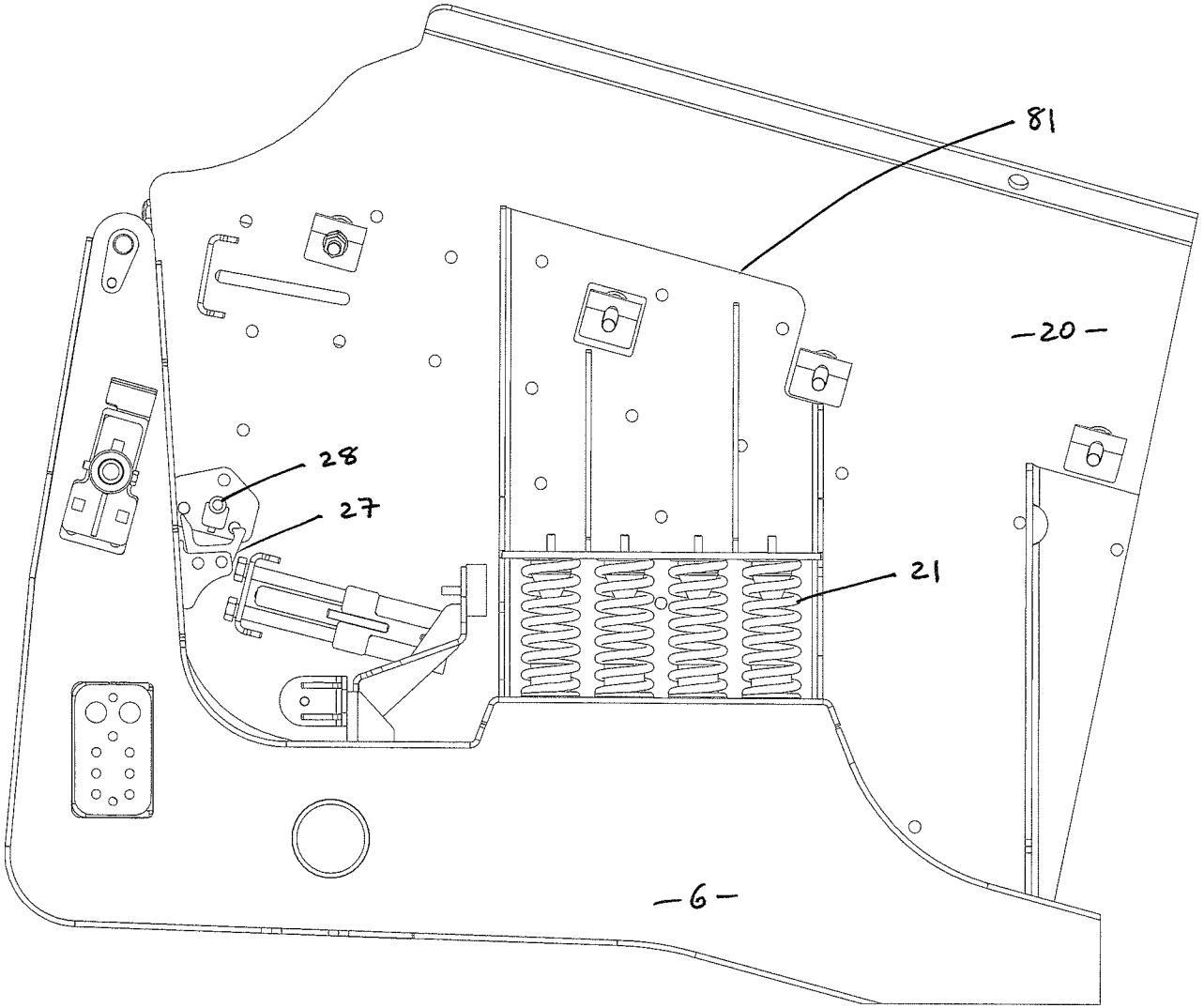
FIGS. 5 and 7 are enlarged side views of portions of FIGS. 4 and 6 respectively

FIG. 5 shows an enlarged portion of the left-hand side of FIG. 4, to more clearly illustrate the position of a screen carry pin 28 on the vibrating screening unit 20 and a complementary screen carry hook or housing 27 on the first sub-frame 6. Complementary pins and hooks are located on the other side of the vibrating screening unit 20 and first sub-frame 6

In the first in-use position of the present invention shown in FIGS. 4 and 5, the screen carry pin 28 is configured to be disengaged or away from the screen carry hook 27, so that the weight of the vibrating screen unit 20 is wholly or substantially only carried through the damper springs 21 in the manner expected in the art.

Figure 7:
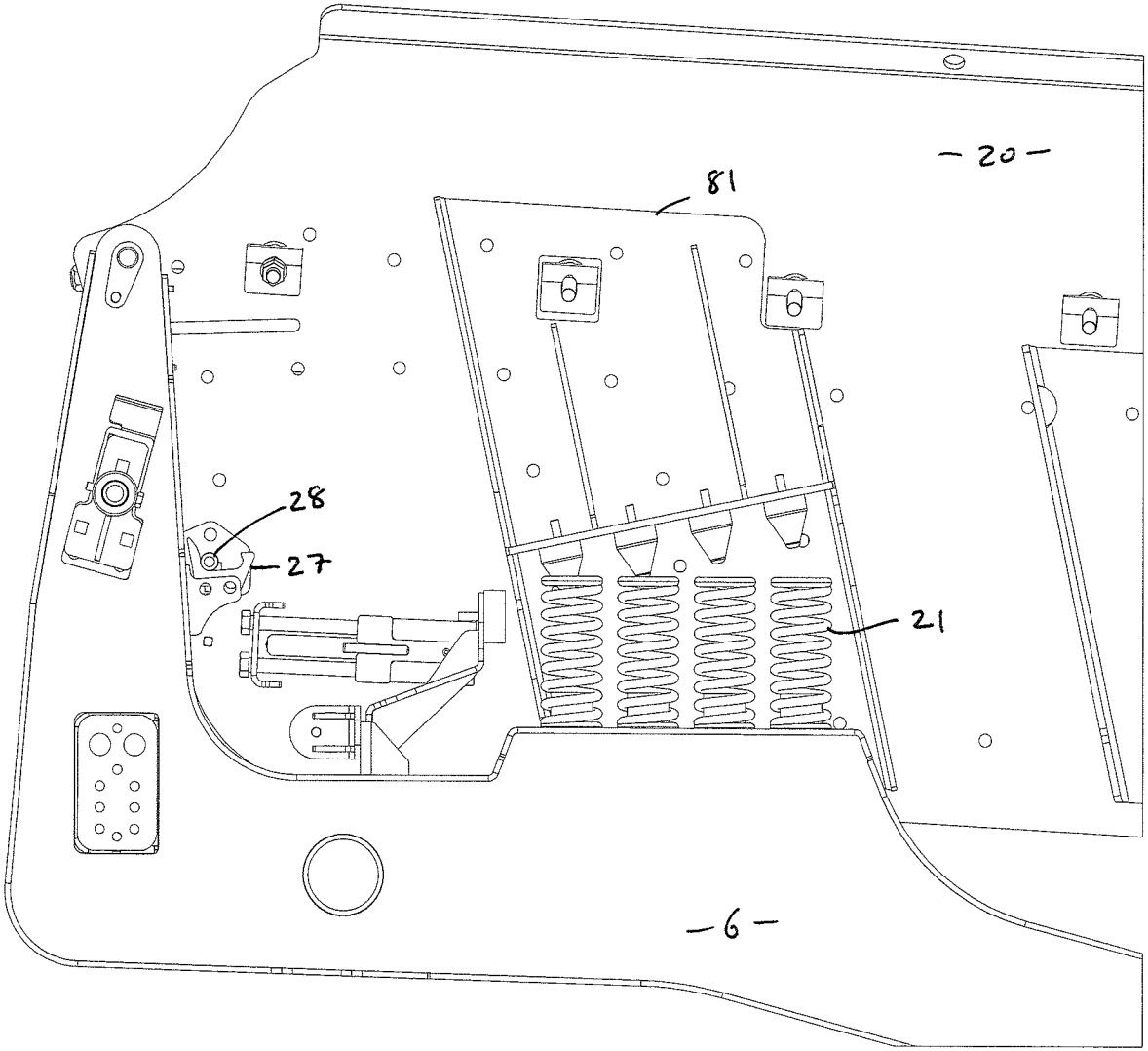

FIG. 7 shows an enlarged portion of the left-hand side of FIG. 6, wherein following the extension of the hydraulic rams 80, the relative movement of the vibrating screening unit 20 is such that the screen carry pins 28 now engage with the screen carry hooks 27, so as to form a pivot for the further motion of the vibrating screening unit 20 relative to the first sub-frame 6. Thus, the weight of the vibrating screening unit 6 is now carried through the screen carry pins 28.

FIGS. 1-3 also show an underscreen conveyor 50 wholly or substantially located beneath the vibrating screening unit 20. The underscreen conveyor 50 comprises a hopper surround 52, and a conveyor 54, and a discharge end 56. The hopper surround 52 may be formed from a series of separable or moveable wings on three sides to form a hopper arrangement so as to increase the discharge catchment area of the underscreen conveyor 50. The vibrating screening unit 20 may include a depending discharge curtain to wholly or substantial co-ordinate with the underscreen conveyor 50 and/or hopper surround 52 to co-ordinate the passage of material therein between.

The underscreen conveyor 50 is able to receive that portion of the feed aggregate material able to pass through all the openings in the upper screens 24 and the lower screens, and thus pass directly down through the vibrating screening unit 20 to fall beneath it. Such portion can be gathered by the hopper arrangement 52, and conveyed by the conveyor 54 in a forward and uphill motion towards its discharge end 56, and onto a third lateral post-screening discharge conveyor 60, only shown in FIG. 2 for clarity purposes.

The underscreen conveyor 50 is supported at one end by a first leg framework 70, and towards its discharge end 56 by a second leg framework 72. Optionally, the first and second leg frameworks 70, 72 are also moveable, generally by the action of one or more actuators or ram and piston arrangements, so as to be able to move the underscreen conveyor 50 from an operational configuration as shown in FIG. 1, able to cooperate in use with the vibrating screening unit 20 and receive a discharge stream therefrom, and a second or non-operational position, as shown in FIG. 3.

Thus, FIG. 3 show an increased access portal 84 between the underscreen conveyor 50 in its second position or configuration, and the lower portion or parts of the vibrating screening unit 20, to allow a user to more access to work on the lower parts or underneath of the vibrating screening unit 20, in particular to replace lower screens 26 when they are either worn out or otherwise broken.

Movement of the vibrating screening unit 20 and/or the underscreen conveyor 50 in reverse direction returns the plant 2 to the in-use position or configuration of FIGS. 1 and 4.

The skilled man can see that movement of the vibrating screening unit is useable with other types of mobile aggregate processing plant to provide or increase access below the vibrating screening unit during maintenance and/or repair and/or replacement work required to maintain the vibrating screening unit, or change the screens and/or absorbers for another reason.

The invention claimed is:

1. A mobile aggregate processing plant for screening aggregate material and to provide at least one aggregate discharge stream, the mobile aggregate processing plant comprising a mobile chassis having:

a main frame;

a screen-mounting frame;

a vibrating screening unit mounted on the screen-mounting frame, one or more absorbers mounting the vibrating screening unit on the screen mounting frame;

one or more actuators between the vibrating screening unit and the screen-mounting frame to move the vibrating screening unit relative to screen-mounting frame between a first in-use position, and at least a second position where the vibrating screening unit is spaced further apart from the screen-mounting frame than in the first in-use position so as to provide an access portal between the vibrating screening unit and the screen-mounting frame.

2. The mobile aggregate processing plant as claimed in claim 1 wherein the vibrating screening unit is moveable at one end relative to the screen-mounting frame between the first in-use position and at least a second position.

3. The mobile aggregate processing plant as claimed in claim 1 wherein the vibrating screening unit is moveable at both ends relative to the screen-mounting frame between the first in-use position and at least a second position.

4. The mobile aggregate processing plant a as claimed in claim 1 wherein one end of the vibrating screening unit is pivotable to the screen-mounting frame during movement of the vibrating screening unit to the second position.

5. The mobile aggregate processing plant as claimed in claim 4 wherein the vibrating screening unit includes pivot pins at least at one end, and the screen-mounting frame includes complementary pin housings, which pins and pin housings are configured to be not engaged when the vibrating screening unit is in the first in-use position, and which pins and pin housings are configured to be engaged when the vibrating screening unit is moving to a second position relative to the screen-mounting frame.

6. The mobile aggregate processing plant as claimed in claim 1 wherein the one or more actuators are selected from a group comprising: springs, ram and pistons, and screws.

7. The mobile aggregate processing plant as claimed in claim 6 wherein the vibrating screening unit is moveable in an upward direction by a hydraulic ram and piston located between the vibrating screening unit and the screen-mounting frame.

8. The mobile aggregate processing plant as claimed in claim 1 further comprising attaching the one or more of the absorbers to either the vibrating screening unit or the screen-mounting frame.

9. The mobile aggregate processing plant as claimed in claim 8 wherein the one or more of the absorbers are damper springs.

10. The mobile aggregate processing plant as claimed in claim 9 wherein the one or more of the absorbers comprise at least two sets of multiple damper springs on each side of the vibrating screening unit.

11. The mobile aggregate processing plant as claimed in claim 1 further comprising an underscreen conveyor located wholly or substantially beneath the vibrating screening unit to wholly or substantially receive said at least one aggregate discharge stream.

12. The mobile aggregate processing plant as claimed in claim 11 wherein the underscreen conveyor is vertically and/or laterally moveable relative to the main frame between a first in-use operating configuration and a second non-operating configuration.

13. The mobile aggregate processing plant as claimed in claim 11 wherein the underscreen conveyor and the vibrating screening unit are movable apart between a co-operating operating configuration and an open non-operating configuration.

14. The mobile aggregate processing plant as claimed in as claimed in claim 1 wherein the vibrating screening unit comprises at least a series of upper screens and a series of lower screens, and a lower screen is removeable when the vibrating screening unit is in the second position.

15. The mobile aggregate processing plant as claimed in as claimed in claim 1 further comprising one or more of the group comprising: an aggregate feed hopper, an aggregate feed conveyor, one or more post-screening discharge conveyors, and a crusher.

16. The A mobile aggregate processing plant as claimed in claim 1 comprising:

the mobile chassis having tracked mobility;

an aggregate feed hopper to receive aggregate material;

an aggregate feed conveyor to transfer the aggregate material to a vibrating screening unit;

the vibrating screening unit having an aggregate feed end and an discharge end, and comprising at least two screens driveable to screen the aggregate material into at least two different aggregate discharge streams of different particle sizes, at least one of which is discharged directly through the vibrating screening unit;

one or more post-screening discharge conveyors able to convey a discharge stream from the vibrating screening unit to a different location.

17. A method of servicing a mobile aggregate processing plant for screening aggregate material comprising a mobile chassis having a main frame and a vibrating screening unit mounted via one or more absorbers on a screen-mounting frame, and one or more actuators between the vibrating screening unit and the screen-mounting frame configured to move the vibrating screening unit relative to the screen-mounting frame, comprising at least the steps of:

moving the vibrating screening unit between a first in-use position, and at least a second position where the vibrating screening unit is spaced further apart from the screen-mounting frame than in the first in-use position so as to provide an access portal below the vibrating screening unit when not in use; and accessing the vibrating screening unit from below.

18. The method as claimed in claim 17 wherein the mobile aggregate processing plant further comprises an underscreen conveyor wholly or substantially located beneath the vibrating screening unit to receive the aggregate discharge stream discharged through the vibrating screening unit, the method further comprising:

moving the underscreen conveyor away from the vibrating screening unit between a co-operating operating configuration and an open non-operating configuration.

* * * * *